US006984312B2

(12) United States Patent
Som et al.

(10) Patent No.: US 6,984,312 B2
(45) Date of Patent: Jan. 10, 2006

(54) PROCESS FOR THE DESULFURIZATION OF LIGHT FCC NAPHTHA

(75) Inventors: Manoj Som, Houston, TX (US); Gary G. Podrebarac, Houston, TX (US); Scott W. Shorey, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 33 days.

(21) Appl. No.: 10/699,712

(22) Filed: Nov. 3, 2003

(65) Prior Publication Data

US 2004/0099574 A1 May 27, 2004

Related U.S. Application Data

(60) Provisional application No. 60/428,638, filed on Nov. 22, 2002.

(51) Int. Cl.
*C10G 45/02* (2006.01)

(52) U.S. Cl. ..... 208/211; 208/208 R; 208/210; 208/212; 208/213

(58) Field of Classification Search ..... 208/208 R, 208/210, 211, 212, 213
See application file for complete search history.

(56) References Cited

U.S. PATENT DOCUMENTS

| | | | | |
|---|---|---|---|---|
| 3,691,066 | A | 9/1972 | Carruthers et al. | 208/255 R |
| 4,055,483 | A | 10/1977 | Mertzweiller et al. | 208/213 |
| 4,194,964 | A | 3/1980 | Chen et al. | 208/108 |
| 4,265,735 | A | 5/1981 | Audeh et al. | 208/234 |
| 4,486,297 | A | 12/1984 | Matsumoto et al. | 208/211 |
| 4,731,229 | A | 3/1988 | Sperandio | 422/188 |
| 5,073,236 | A | 12/1991 | Gelbein et al. | 203/29 |
| 5,169,516 | A | 12/1992 | Carr | 208/189 |
| 5,320,742 | A | 6/1994 | Fletcher et al. | 208/89 |
| 5,321,163 | A | 6/1994 | Hickey et al. | 568/59 |
| 5,431,888 | A | 7/1995 | Hickey et al. | 422/191 |
| 5,510,089 | A | 4/1996 | Jones | 422/189 |
| 5,510,568 | A | 4/1996 | Hearn | 585/834 |
| 5,595,634 | A | 1/1997 | Hearn et al. | 203/29 |
| 5,597,476 | A | 1/1997 | Hearn et al. | 208/208 R |
| 5,659,106 | A | 8/1997 | Frey et al. | 585/803 |
| 5,759,386 | A | 6/1998 | Frey | 208/217 |
| 5,779,883 | A | 7/1998 | Hearn et al. | 208/213 |
| 5,807,477 | A | 9/1998 | Hearn et al. | 208/238 |
| 5,851,383 | A | 12/1998 | Frey | 208/217 |
| 6,083,378 | A | 7/2000 | Gildert et al. | 208/209 |
| 6,231,752 | B1 | 5/2001 | Putman | 208/213 |
| 6,303,020 | B1 | 10/2001 | Podrebarac et al. | 208/210 |
| 6,416,658 | B1 | 7/2002 | Maraschino et al. | 208/189 |
| 6,444,118 | B1 | 9/2002 | Podrebarac et al. | 208/210 |
| 6,495,030 | B1 | 12/2002 | Podrebarac | 208/218 |
| 6,592,750 | B2 | 7/2003 | Podrebarac et al. | 208/210 |
| 2003/0136706 | A1 | 7/2003 | McDaniel et al. | |

FOREIGN PATENT DOCUMENTS

| | | |
|---|---|---|
| EP | 0 725 126 A1 | 8/1996 |

*Primary Examiner*—Walter D. Griffin
(74) *Attorney, Agent, or Firm*—Kenneth H. Johnson

(57) ABSTRACT

A process for the treatment of a light cracked naphtha is disclosed wherein the light cracked naphtha is first subjected to thioetherification and fractionation into two boiling fractions. The lower boiling fraction is removed as overheads for later recombination with the product and the higher boiling fraction is combined with a heavy cracked naphtha and subjected to simultaneous hydrodesulfurization and fractionation to separate the higher boiling fraction from the heavy cracked naphtha which is recycled. The recycled heavy cracked naphtha is eventually desulfurized and hydrogenated to produce a clean solvent which washes the catalyst and extends catalyst life.

14 Claims, 1 Drawing Sheet

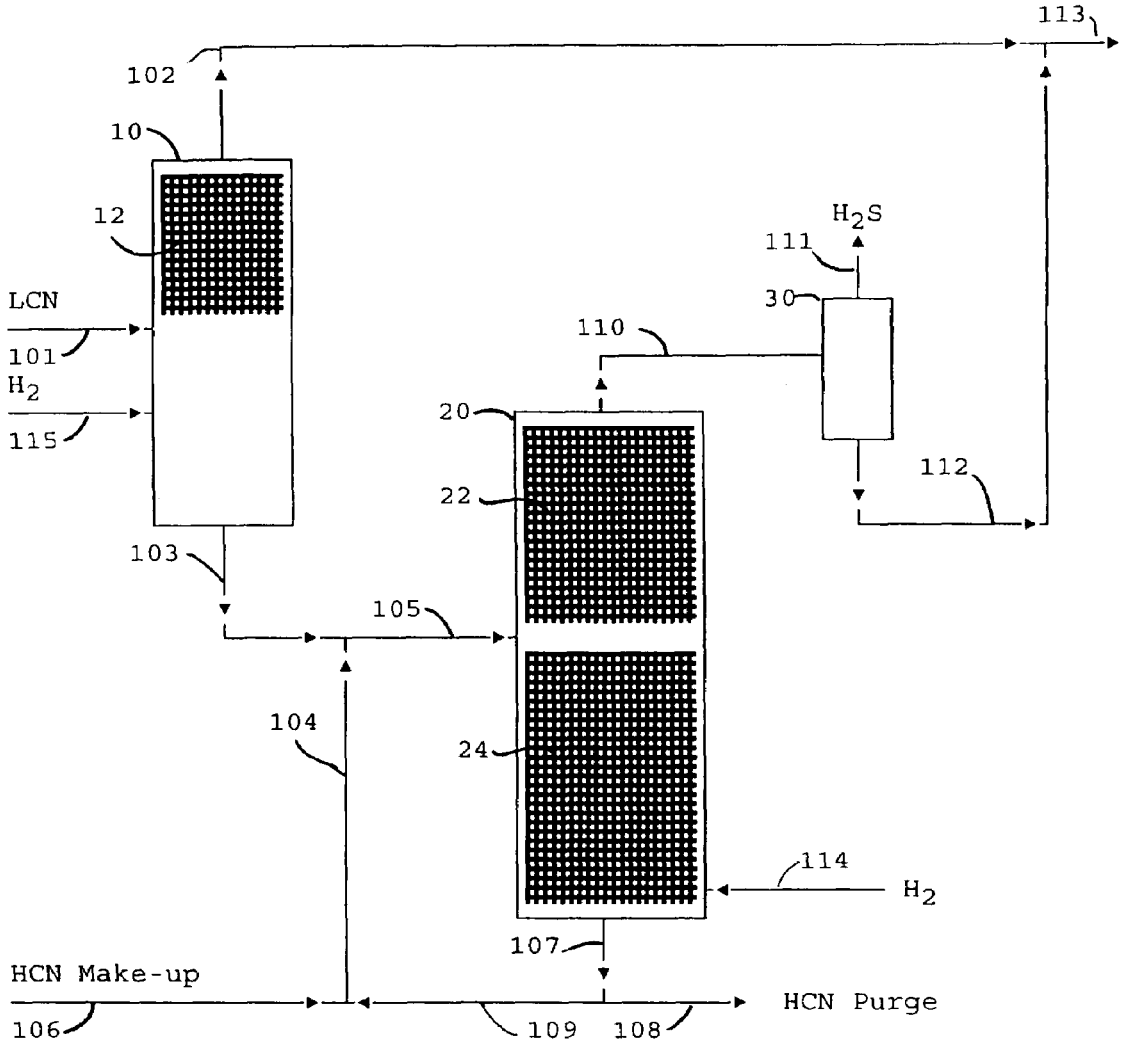
113
102
10
12
$H_2S$
111
30
LCN
101
110
$H_2$
115
20
22
112
103
105
104
24
114
$H_2$
107
HCN Make-up
HCN Purge
106
109
108

PROCESS FOR THE DESULFURIZATION OF LIGHT FCC NAPHTHA

This application claims the benefit of provisional application 60/428,638 filed Nov. 22, 2002.

BACKGROUND OF THE INVENTION

1. Field of the Invention

The present invention relates to a process for the desulfurization of a light boiling range fluid catalytic cracked naphtha. More particularly the present invention employs catalytic distillation steps which reduce sulfur to very low levels, makes more efficient use of hydrogen and causes less olefin hydrogenation for a full boiling range naphtha stream.

2. Related Information

Petroleum distillate streams contain a variety of organic chemical components. Generally the streams are defined by their boiling ranges which determine the composition. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds.

The composition of untreated naphtha as it comes from the crude still, or straight run naphtha, is primarily influenced by the crude source. Naphthas from paraffinic crude sources have more saturated straight chain or cyclic compounds. As a general rule most of the "sweet" (low sulfur) crudes and naphthas are paraffinic. The naphthenic crudes contain more unsaturates and cyclic and polycylic compounds. The higher sulfur content crudes tend to be naphthenic. Treatment of the different straight run naphthas may be slightly different depending upon their composition due to crude source.

Reformed naphtha or reformate generally requires no further treatment except perhaps distillation or solvent extraction for valuable aromatic product removal. Reformed naphthas have essentially no sulfur contaminants due to the severity of their pretreatment for the process and the process itself.

Cracked naphtha as it comes from the catalytic cracker has a relatively high octane number as a result of the olefinic and aromatic compounds contained therein. In some cases this fraction may contribute as much as half of the gasoline in the refinery pool together with a significant portion of the octane.

Catalytically cracked naphtha gasoline boiling range material currently forms a significant part (≈⅓) of the gasoline product pool in the United States and it provides the largest portion of the sulfur. The sulfur impurities may require removal, usually by hydrotreating, in order to comply with product specifications or to ensure compliance with environmental regulations. Some users wish the sulfur of the final product to be below 50 wppm.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCI+H_2 \rightarrow RH+HCI \quad (2)$$

$$2RN+4H_2 \rightarrow 2RH+2NH_3 \quad (3)$$

$$ROOH+2H_2 \rightarrow RH+2H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized naphtha. The loss of olefins by incidental hydrogenation is detrimental by the reduction of the octane rating of the naphtha and the reduction in the pool of olefins for other uses.

In addition to supplying high octane blending components the cracked naphthas are often used as sources of olefins in other processes such as etherifications. The conditions of hydrotreating of the naphtha fraction to remove sulfur will also saturate some of the olefinic compounds in the fraction reducing the octane and causing a loss of source olefins.

Various proposals have been made for removing sulfur while retaining the more desirable olefins. Since the valuable olefins in the cracked naphtha are mainly in the low boiling fraction of these naphthas and the sulfur containing impurities tend to be concentrated in the high boiling fraction the most common solution has been prefractionation prior to hydrotreating. The conventional prefractionation produces a light boiling range naphtha which boils in the range of $C_5$ to about 250° F. and a heavy boiling range naphtha which boils in the range of from about 250–475° F.

The predominant light or lower boiling sulfur compounds are mercaptans while the heavier or higher boiling compounds are thiophenes and other heterocyclic compounds. The separation by fractionation alone will not remove the mercaptans. However, in the past the mercaptans have been removed by oxidative processes involving caustic washing. A combination oxidative removal of the mercaptans followed by fractionation and hydrotreating of the heavier fraction is disclosed in U.S. Pat. No. 5,320,742. In the oxidative removal of the mercaptans the mercaptans are converted to the corresponding disulfides.

U.S. Pat. No. 5,597,476 discloses a two-step process in which naphtha is fed to a first distillation column reactor which acts as a depentanizer or dehexanizer with the lighter material containing most of the olefins and mercaptans being boiled up into a first distillation reaction zone where the mercaptans are reacted with diolefins to form sulfides which are removed in the bottoms along with any higher boiling sulfur compounds. The bottoms are subjected to hydrodesulfurization in a second distillation column reactor where the sulfur compounds are converted to $H_2S$ and removed.

SUMMARY OF THE INVENTION

Briefly a light cracked naphtha (LCN) is fractionated and a higher boiling naphtha fraction (about 165–350° F.) of light cracked naphtha (LCN) is fed, along with hydrogen, to a distillation column reactor along with some heavy cracked naphtha (HCN) boiling in the range of 350–450° F. The distillation column reactor contains a standard hydrodesulfurization catalyst which causes the organic sulfur compounds (mercaptans, sulfides and thiophenes) to react with the hydrogen to form hydrogen sulfide. The HCN is used as a solvent so that the distillation column reactor may be operated at higher temperatures and still have boiling material in the catalyst bed. In addition it continuously washes the catalyst to remove coke build up and extend catalyst life.

The HCN is removed as bottoms and recycled to the distillation column reactor while the now hydrodesulfurized higher boiling naphtha fraction of the LCN, is taken as overheads along with unreacted hydrogen and hydrogen sulfide where the hydrogen sulfide is removed.

In a preferred embodiment a light cracked naphtha (LCN) is subjected to a two-stage process for the removal of organic sulfur first by thioetherification and fractionation of a heavier fraction which is then subjected to hydrodesulfurization. In the first stage the light naphtha boiling in a range of about $C_5$–350° F. is subjected to thioetherification, more preferably in a distillation column reactor wherein most of the mercaptans are reacted with the diolefins to produce sulfides. In addition the distillation column reactor acts as a splitter taking a lower boiling range naphtha fraction (about $C_5$–165° F.) overhead which is substantially reduced in total sulfur content, especially the mercaptans. A higher boiling naphtha fraction (about 165–350° F.) is taken as bottoms which includes the sulfides made in the reactor.

The bottoms are fed, along with hydrogen, to a distillation column reactor along with some heavy cracked naphtha HCN boiling in the range of 350–450° F. In the more preferred embodiment the second distillation column reactor contains a standard hydrodesulfurization catalyst which causes the organic sulfur compounds (mercaptans, sulfides and thiophenes) to react with the hydrogen to form hydrogen sulfide. As noted the HCN is used as a solvent so that the distillation column reactor may be operated at higher temperatures and still have boiling material in the catalyst bed, while continuously washing the catalyst to remove coke build up and extend catalyst life. The HCN is removed as bottoms and recycled to the distillation column reactor while the now hydrodesulfurized higher boiling naphtha fraction of the LCN from the first reactor, is taken as overheads along with unreacted hydrogen and hydrogen sulfide where the hydrogen sulfide is removed. The higher boiling fraction may then be mixed back with the lower boiling naphtha fraction from the first reactor to produce a low sulfur product.

The HCN which is recycled eventually is substantially desulfurized and the olefins contained therein are hydrogenated to produce a clean solvent.

As used herein the term "distillation column reactor" means a distillation column which also contains catalyst such that reaction and distillation are going on concurrently in the column. In a preferred embodiment the catalyst is prepared as a distillation structure and serves as both the catalyst and distillation structure. As used herein the term "distillation reaction zone" means the area within a distillation column reactor.

The terms "lower boiling" and "higher boiling" are relative to the full boiling LCN material. As in any fractional distillation a lower material is taken overhead and a higher boiling material is taken as bottoms. The boiling points may be adjusted to obtain the desired degree of thioetherification and desulfurization.

BRIEF DESCRIPTION OF THE DRAWING

The FIGURE is a flow diagram in schematic form of the preferred embodiment of the invention.

DETAILED DESCRIPTION

The feed to the process comprises a sulfur-containing petroleum fraction from a fluidized bed catalytic cracking unit (FCCU) which boils in the light gasoline boiling range ($C_5$ to about 350° F.) which is designated light cracked naphtha or LCN. Generally the process is useful on the naphtha boiling range material from catalytic cracker products because they contain the desired olefins and unwanted sulfur compounds. Straight run naphthas have very little olefinic material, and unless the crude source is "sour", very little sulfur.

The sulfur content of the catalytically cracked fractions will depend upon the sulfur content of the feed to the cracker as well as the boiling range of the selected fraction used as feed to the process. Lighter fractions will have lower sulfur contents than higher boiling fractions. The front end of the naphtha contains most of the high octane olefins but relatively little of the sulfur. The sulfur components in the front end are mainly mercaptans and typical of those compounds are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), isoamyl mercaptan (b.p. 250° F.), n-amyl mercaptan (b.p. 259° F.), α-methylbutyl mercaptan (b.p. 234° F.), α-ethylpropyl mercaptan (b.p. 293° F.), n-hexyl mercaptan (b.p. 304° F.), 2-mercapto hexane (b.p. 284° F.), and 3-mercapto hexane (b.p. 135° F.). Typical sulfur compounds found in the heavier boiling fraction include the heavier mercaptans, thiophenes sulfides and sulfides.

Thioetherification

The reaction of mercaptans with diolefins to produce sulfides herein is termed thioetherification. A suitable catalyst for the reaction of the diolefins with the mercaptans is 0.4 wt % Pd on 7 to 14 mesh $Al_2O_3$ (alumina) spheres, supplied by Süd-Chemie (formerly United Catalyst Inc.), designated as G-68C. Typical physical and chemical properties of the catalyst as provided by the manufacturer are as follows:

TABLE I

| | |
|---|---|
| Designation | G-68C |
| Form | Sphere |
| Nominal size | 7 × 14 mesh |
| Pd. wt % | 0.4 (0.37–0.43) |
| Support | High purity alumina |

Another catalyst useful for the mercaptan-diolefin reaction is 58 wt % Ni on 8 to 14 mesh alumina spheres, supplied by Calcicat, designated as E-475-SR. Typical physical and chemical properties of the catalyst as provided by the manufacturer are as follows:

TABLE II

| | |
|---|---|
| Designation | E-475-SR |
| Form | Spheres |
| Nominal size | 8 × 14 Mesh |
| Ni wt % | 54 |
| Support | Alumina |

Hydrogen is provided as necessary to support the reaction and to reduce the oxide and maintain it in the hydride state.

The distillation column reactor is operated at a pressure such that the reaction mixture is boiling in the bed of catalyst. A "froth level" may be maintained throughout the catalyst bed by control of the bottoms and/or overheads withdrawal rate which may improve the effectiveness of the catalyst thereby decreasing the height of catalyst needed. As may be appreciated the liquid is boiling and the physical state is actually a froth having a higher density than would be normal in a packed distillation column but less than the liquid without the boiling vapors.

The present process preferably operates at overhead pressure of said distillation column reactor in the range between 0 and 250 psig and temperatures within said distillation reaction zone in the range of 100 to 300° F., preferably 130 to 270° F.

The feed and the hydrogen are preferably fed to the distillation column reactor separately or they may be mixed prior to feeding. A mixed feed is fed below the catalyst bed or at the lower end of the bed. Hydrogen alone is fed below the catalyst bed and the hydrocarbon stream is fed below the bed to about the mid one-third of the bed. The pressure selected is that which maintains catalyst bed temperature between 100° F. and 300° F.

Hydrodesulfurization

The reaction of organic sulfur compounds in a refinery stream with hydrogen over a catalyst to form $H_2S$ is typically called hydrodesulfurization. Hydrotreating is a broader term which includes saturation of olefins and aromatics and the reaction of organic nitrogen compounds to form ammonia. However hydrodesulfurization is included and is sometimes simply referred to as hydrotreating.

Catalysts which are useful for the hydrodesulfurization reaction include Group VIII metals such as cobalt, nickel, palladium, alone or in combination with other metals such as molybdenum or tungsten on a suitable support which may be alumina, silica-alumina, titania-zirconia or the like. Normally the metals are provided as the oxides of the metals supported on extrudates or spheres and as such are not generally useful as distillation structures.

The catalysts may additionally contain components from Group V and VIB metals of the Periodic Table or mixtures thereof. The use of the distillation system reduces the deactivation and provides for longer runs than the fixed bed hydrogenation units of the prior art. The Group VIII metal provides increased overall average activity. Catalysts containing a Group VIB metal such as molybdenum and a Group VIII such as cobalt or nickel are preferred. Catalysts suitable for the hydrodesulfurization reaction include cobalt-molybdenum, nickel-molybdenum and nickel-tungsten. The metals are generally present as oxides supported on a neutral base such as alumina, silica-alumina or the like. The metals are reduced to the sulfide either in use or prior to use by exposure to sulfur compound containing streams.

The properties of a typical hydrodesulfurization catalyst are shown in Table III below.

TABLE III

| | |
|---|---|
| Manufacture | Criterion Catalyst Co. |
| Designation | DC-130 |
| Form | Trilobe |
| Nominal size | 1.3 mm diameter |
| Metal, Wt. % | |
| Cobalt | 3.4 |
| Molybdenum | 13.6 |
| Support | Alumina |

The catalyst typically is in the form of extrudates having a diameter of 1/8, 1/16 or 1/32 inches and an L/D of 1.5 to 10. The catalyst also may be in the form of spheres having the same diameters. In their regular form they form too compact a mass and are preferably prepared in the form of a catalytic distillation structure. The catalytic distillation structure must be able to function as catalyst and as mass transfer medium. Catalytic distillation structures useful for this purpose are disclosed in U.S. Pat. Nos. 4,731,229, 5,073,236, 5,431,890 and 5,266,546 which are incorporated by reference.

The distillation column reactor is advantageously used to react the heavier or higher boiling sulfur compounds. The overhead pressure is maintained at about 0 to 350 psig with the corresponding temperature in the distillation reaction zone of between 450 to 700° F. Hydrogen partial pressures of 0.1 to 70 psia, more preferably 0.1 to 10 are used, with hydrogen partial pressures in the range of 0.5 to 50 psia giving optimum results.

The operation of the distillation column reactor results in both a liquid and vapor phase within the distillation reaction zone. A considerable portion of the vapor is hydrogen while a portion is vaporous hydrocarbon from the petroleum fraction. Actual separation may only be a secondary consideration.

Without limiting the scope of the invention it is proposed that the mechanism that produces the effectiveness of the present process is the condensation of a portion of the vapors in the reaction system, which occludes sufficient hydrogen in the condensed liquid to obtain the requisite intimate contact between the hydrogen and the sulfur compounds in the presence of the catalyst to result in their hydrogenation. In particular, sulfur species concentrate in the liquid while the olefins and $H_2S$ concentrate in the vapor allowing for high conversion of the sulfur compounds with low conversion of the olefin species.

The result of the operation of the process in the distillation column reactor is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. The lower boiling fraction, which contains more easily removable sulfur compounds, is subjected to lower temperatures at the top of the column which provides for greater selectivity, that is, less hydrocracking or saturation of desirable olefinic compounds. The higher boiling portion is subjected to higher temperatures in the lower end of the distillation column reactor to crack open the sulfur containing ring compounds and hydrogenate the sulfur.

Referring now to the FIGURE there is shown a schematic flow diagram of one embodiment of the invention.

A light cracked naphtha is fed to a thioetherification reactor 10 containing a bed of thioetherification catalyst 12 through flow line 101 with hydrogen being fed through flow line 115. The thioetherification reactor is configured to act as a light naphtha splitter. The mercaptans in the LCN are reacted with the diolefins to form higher boiling sulfides. A lower boiling fraction substantially reduced in mercaptans is removed as overheads via flow line 102. A higher boiling fraction containing the sulfides, some unreacted mercaptans and higher boiling sulfur compounds, such as thiophene, is taken as bottoms via flow line 103.

The bottoms, or higher boiling fraction, from the thioetherification reactor 10 in flow line 103 are combined with a HCN and fed via flow line 105 to a hydrodesulfurization reactor 20 having beds 22 and 24 of hydrodesulfurization catalyst. The ratio of LCN to HCN in the feed to the hydrodesulfurization reactor can be in the range of 2:1 to 4:1

In the hydrodesulfurization reactor the organic sulfur compounds including sulfides, mercaptans and thiophene, are reacted with hydrogen to produce hydrogen sulfide. In addition the higher boiling fraction of the LCN is distilled overhead via flow line 110 along with the unreacted hydrogen and the hydrogen sulfide. The hydrogen sulfide and hydrogen are separated from the overheads in a separator 30 and removed via flow line 111. The liquid is removed from the separator 30 via flow line 112 and recombined with the lower boiling fraction in flow line 102 to produce a product having a reduced total sulfur content.

If desired the overheads in flow line 110 may be subjected to further subjected to hydrodesulfurization in a polishing reactor which is not shown.

The HCN is removed from the hydrodesulfurization reactor 20 as bottoms via flow line 107 and a small purge is taken via flow line 108. The remainder of the HCN bottoms is recycled via flow line 109 with make up HCN in flow line 104. As the HCN is recycled the sulfur content is reduced and the olefins are saturated in the lower catalyst bed 24 which provides a clean solvent. The clean solvent provides a washing action which removes coke and other detrimental products from the catalyst which greatly increases the catalyst life. As may be noted in the following example the observed rate constant for the conversion of sulfur actually increased during operation. If desired a catalyst which has enhanced hydrogenation properties, such as nickel and molybdenum oxides on an alumina support may be used in the lower which will speed up the hydrogenation of the olefines in the HCN.

EXAMPLE

In the following example presented in tabular form below the lower boiling fraction from a thioetherification reactor/splitter is fed along with HCN to a hydrodesulfurization reactor between two beds containing hydrodesulfurization catalyst.

| | Feeds | |
|---|---|---|
| ASTM D-3710 | LCN | HCN |
| IBP | 146 | 382 |
| 5% | 161 | 394 |
| 10% | 173 | 401 |
| 20% | 191 | 409 |
| 50% | 235 | 431 |
| 80% | 295 | 447 |
| 90% | 328 | 460 |
| 95% | 341 | 491 |
| EP | 381 | 515 |
| Total S (ppm) | 598 | 5.9 |

| Conditions and results | |
|---|---|
| Time on stream, hrs | 354 |
| LCN feed rate, lb//hr | 40.0 |
| HCN feed rate, lb/hr | 10.0 |
| Mixed Sulfur content, wppm | 480 |
| % feed flashed | 39.9 |
| Liquid feed temp, ° F. | 498.5 |
| Hydrogen rate, SCFH | 81 |
| Sulfur in LCN Converted, %* | 97.07 |
| Bromine No. in LCN Converted, %* | 33.76 |
| Final Bromine No. | 48.5 |
| Final total Sulfur, wppm | 23.5 |
| OH recovery, % of mixed feed | 83.98 |
| $H_2$ Conversion, % | 30.70 |
| $H_2$ Consumed, SCF/BBL | 166 |

-continued

| | |
|---|---|
| Est. $H_2$ Concentration in Vapor at top | 0.1389 |
| Est. $H_2$ Concentration in Vapor at bottom | 0.2913 |
| Overhead pressure, psig | 210 |
| Throughput, bbl/day/ft.$^3$ | 2.29 |
| Upper bed temp., ° F. | 513 |
| Lower bed temp., ° F. | 598 |
| R + M/2 loss | 3.5 |
| R loss | 5.1 |
| M loss | 1.9 |
| Observed rate constant at beginning of run | 0.025 |
| Observed rate constant at end of run | 0.032 |

*conversion is based on properties of LCN only

The invention claimed is:

1. A process for the treatment of light cracked naphtha, containing organic sulfur compounds, comprising the steps of:

(a) fractionating a light cracked naphtha and recovering a first higher boiling naphtha fraction;

(b) feeding hydrogen, a heavy cracked naphtha and said first higher boiling naphtha fraction to a distillation reaction zone containing a hydrodesulfurization catalyst;

(c) concurrently in said distillation reaction zone:

(i) reacting a portion of said organic sulfur compounds with hydrogen to produce hydrogen sulfide, and (ii) separating a lower boiling naphtha fraction containing said hydrogen sulfide and a second higher boiling naphtha fraction comprising said heavy cracked naphtha by fractional distillation;

(d) removing said lower boiling naphtha fraction from said distillation reaction zone as overheads;

(e) removing the hydrogen sulfide from said overheads; and (f) removing said second higher boiling naphtha fraction from said distillation reaction zone recycling said heavy cracked naphtha to said distillation reaction zone along with said first higher boiling naphtha fraction, whereby the heavy cracked naphtha is used as a solvent so that the distillation column reactor may be operated at higher temperatures and still have boiling material in the catalyst bed.

2. A process for the treatment of light cracked naphtha comprising the steps of:

(a) feeding hydrogen and a light cracked naphtha containing olefins, diolefins, mercaptans and heavier organic sulfur compounds to a first reaction zone containing a thioetherification catalyst;

(b) reacting a portion of the mercaptans with a portion of the diolefins to produce sulfides;

(c) separating a first lower boiling naphtha fraction of the light cracked naphtha from a first higher boiling naphtha fraction of the light cracked naphtha by fractional distillation, said higher boiling naphtha fraction containing said sulfides and said heavier organic sulfur compounds;

(d) removing said first lower boiling naphtha fraction as a first overheads, said first lower boiling naphtha fraction having a reduced total sulfur content from said light cracked naphtha;

(e) removing a first higher boiling fraction as a first bottoms from said distillation;

(f) feeding hydrogen, a heavy cracked naphtha along with said first bottoms to a distillation reaction zone containing a hydrodesulfurization catalyst;

(g) concurrently in said distillation reaction zone:
(i) reacting a portion of said sulfides and heavier organic sulfur compounds with hydrogen to produce hydrogen sulfide, and
(ii) separating a second lower boiling naphtha fraction containing said hydrogen sulfide and a second higher boiling naphtha fraction containing said heavy cracked naphtha by fractional distillation;
(h) removing said second lower boiling naphtha fraction from said distillation reaction zone as a second overheads;
(i) removing the hydrogen sulfide from said second overheads;
(j) combining said second overheads with said first overheads to produce a low sulfur product;
(k) removing said second higher boiling naphtha fraction containing less sulfur than said heavy cracked naphtha, from said second distillation reaction zone as a second bottoms;
(l) recycling said heavy cracked naphtha to said second distillation reaction zone along with said first bottoms, whereby the heavy cracked naphtha is used as a solvent so that the distillation column reactor may be operated at higher temperatures and still have boiling material in the catalyst bed.

3. The process according to claim 2 further comprising the steps of:
(m) feeding said first overheads and hydrogen to a single pass reaction zone containing a hydrodesulfurization catalyst wherein additional mercaptans and organic sulfur compounds are reacted with hydrogen to produce additional hydrogen sulfide; and
(n) separating said additional hydrogen sulfide from the effluent from said single pass reaction zone.

4. The process according to claim 2 wherein the ratio of said first bottoms to said heavy cracked naphtha is between 2:1 and 4:1.

5. A process for the treatment of light cracked naphtha comprising the steps of:
(a) feeding hydrogen and a light cracked naphtha containing olefins, diolefins, mercaptans and heavier organic sulfur compounds to a first distillation reaction zone containing a thioetherification catalyst;
(b) concurrently in the first distillation reaction zone:
(i) reacting a portion of the mercaptans with a portion of the diolefins to produce sulfides and
(ii) separating a first lower boiling naphtha fraction of the light cracked naphtha from a first higher boiling naphtha fraction of the light cracked naphtha by fractional distillation, said higher boiling naphtha fraction containing said sulfides and said heavier organic sulfur compounds;
(c) removing said first lower boiling naphtha fraction as a first overheads from said first distillation reaction zone, said lower boiling naphtha fraction having a reduced total sulfur content from said light cracked naphtha;
(d) removing said first higher boiling fraction as a first bottoms from said first distillation reaction zone;
(e) feeding hydrogen, a heavy cracked naphtha and said first bottoms to a second distillation reaction zone containing a hydrodesulfurization catalyst;
(f) concurrently in said second distillation reaction zone:
(i) reacting a portion of said sulfides and heavier organic sulfur compounds with hydrogen to produce hydrogen sulfide, and
(ii) separating a second lower boiling naphtha fraction containing said hydrogen sulfide and a second higher boiling naphtha fraction containing said heavy cracked naphtha by fractional distillation;
(g) removing said second lower boiling naphtha fraction from said second distillation reaction zone as a second overheads;
(h) removing the hydrogen sulfide from said second overheads;
(i) combining said second overheads with said first overheads to produce a low sulfur product;
(j) removing said second higher boiling naphtha fraction containing less sulfur than said heavy cracked naphtha, from said second distillation reaction zone as a second bottoms;
(k) recycling said heavy cracked naphtha to said second distillation reaction zone along with said first bottoms whereby the heavy cracked naphtha is used as a solvent so that the distillation column reactor may be operated at higher temperatures and still have boiling material in the catalyst bed.

6. The process according to claim 5 wherein a small purge is taken from said second bottoms.

7. The process according to claim 6 wherein said heavy cracked naphtha is fed to said second distillation reaction zone at a rate to make up for the portion purged.

8. The process according to claim 5 wherein said second distillation reaction zone contains an upper bed of hydrodesulfurization catalyst above a feed point and a lower bed of hydrodesulfurization catalyst below the feed point.

9. The process according to claim 8 wherein said thioetherification catalyst comprises a bed positioned in an upper portion of a distillation column reactor.

10. The process according to claim 8 wherein the second lower boiling naphtha fraction is distilled into the upper bed and the second higher boiling naphtha fraction is distilled into a lower bed.

11. The process according to claim 5 further comprising the steps of:
(l) feeding said first overheads and hydrogen to a single pass reaction zone containing a hydrodesulfurization catalyst wherein additional mercaptans and organic sulfur compounds are reacted with hydrogen to produce additional hydrogen sulfide; and
(m) separating said additional hydrogen sulfide from the effluent from said single pass reaction zone.

12. The process according to claim 8 wherein the catalyst in said upper bed comprises cobalt and molybdenum oxides supported on an alumina base and the catalyst in said lower bed comprises nickel and molybdenum oxides supported on an alumina base.

13. The process according to claim 5 wherein the ratio of said first bottoms to said heavy cracked naphtha is between 2:1 and 4:1.

14. In a process for treating a higher boiling naphtha fraction of a light cracked naphtha to remove organic sulfur compounds comprising:
(b) feeding hydrogen and said higher boiling naphtha fraction of a light cracked naphtha to a distillation reaction zone containing a hydrodesulfurization catalyst;
(c) concurrently in said distillation reaction zone:
(i) reacting a portion of said organic sulfur compounds with hydrogen to produce hydrogen sulfide, and
(ii) separating a lower boiling naphtha fraction containing said hydrogen sulfide and a second higher boiling naphtha fraction by fractional distillation;
(d) removing said lower boiling naphtha fraction from said distillation reaction zone as overheads;

(e) removing the hydrogen sulfide from said second overheads; and (f) removing said second higher boiling naphtha fraction from said distillation reaction zone;

wherein the improvement comprises feeding a heavy cracked naphtha in step (b) and removing said heavy cracked naphtha in said second higher boiling naphtha fraction in step (f) and recycling said heavy cracked naphtha to step (b) whereby the heavy cracked naphtha is used as a solvent so that the distillation column reactor may be operated at higher temperatures and still have boiling material in the catalyst bed.

* * * * *